US005900889A

United States Patent [19]

Tsukuda

[11] Patent Number: 5,900,889

[45] **Date of Patent: *May 4, 1999**

[54] INK-JET RECORDING APPARATUS WITH RECOVERY AT CONTROLLED TIME INTERVALS

[75] Inventor: Keiichiro Tsukuda, Kawasaki, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/508,251

[22] Filed: Jul. 27, 1995

[30] Foreign Application Priority Data

Jul. 28, 1994 [JP] Japan ..... 6-176841

[51] Int. Cl.[6] ..... B41J 2/165

[52] U.S. Cl. ..... 347/23; 347/30; 347/35

[58] Field of Search ..... 347/23, 17, 14, 347/30, 35

[56] References Cited

U.S. PATENT DOCUMENTS

| | | | |
|---|---|---|---|
| 5,245,362 | 9/1993 | Iwata et al. | 347/23 |
| 5,572,242 | 11/1996 | Fujii et al. | 347/23 |
| 5,592,200 | 1/1997 | Kaneko | 347/23 |

FOREIGN PATENT DOCUMENTS

| | | | |
|---|---|---|---|
| 0480473 | 4/1992 | European Pat. Off. | B41J 2/165 |
| 0 608 104 | 7/1994 | European Pat. Off. | B41J 2/175 |
| 0608104 | 7/1994 | European Pat. Off. | B41J 2/175 |
| 3234541 | 10/1991 | Japan | B41J 2/175 |
| 3234543 | 10/1991 | Japan | B41J 2/18 |
| 6008458 | 1/1994 | Japan | B41J 2/165 |

*Primary Examiner*—Benjamin R. Fuller
*Assistant Examiner*—Thien Tran
*Attorney, Agent, or Firm*—Fitzpatrick, Cella, Harper &Scinto

[57] ABSTRACT

An ink-jet recording apparatus using a detachable ink-jet recording head for ejecting ink and a detachable ink container for containing ink to be supplied to the recording head includes: a recovery device for recovering a condition for ejecting ink for the ink-jet recording head; a detection device for detecting a replacement of the ink container or a refilling thereof with ink; a counting device for counting the number of times N that recovery is executed by the recovery device; a measurement device for measuring a period of time elapsing between the time t0 at which last ink ejection was finished and the time at which ink ejection is newly performed; and a control device for controlling the recovery device according to detection result by the detection device, counting result by the counting device and measurement result by the measurement device. A recovery method for an ink-jet recording apparatus includes: a detection step for detecting a replacement of an ink container or a refilling thereof with ink; and a recovery step for recovering the ink-jet recording head at a relatively short interval directly after detection in the detection step as compared to the subsequent recovery intervals, which gradually increase until next detection.

12 Claims, 7 Drawing Sheets

INK-JET RECORDING APPARATUS WITH RECOVERY AT CONTROLLED TIME INTERVALS

BACKGROUND OF THE INVENTION

1. Field of the Invention

The present invention relates to an information processing system, such as a copying machine, a facsimile apparatus, a printer, a word processor, or a personal computer, and to an ink jet recording apparatus for outputting information in the form of characters, images, etc. onto a recording medium in such a system, and further to recovery method of the ink jet recording apparatus.

2. Description of the Related Art

Recording apparatuses which record on a printing medium, such as paper, cloth, plastic sheet, or OHP (Over Head Projector) sheet (hereinafter simply referred to as "recording paper") have been proposed in forms allowing the mounting of a recording head that is, for example, of a wire-dot type, thermal type, thermal transfer type, or ink-jet type.

Of these types of recording heads, the ink-jet type ones are roughly divided, in terms of ink-droplet forming process and of ejection-energy generating method, into continuous-type ones (including charged-particle controlling type and spray-type) and on-demand type ones (including piezo type, spark type and type utilizing thermal energy).

A continuous-type ink-jet recording head continuously ejects ink, imparting electric charge exclusively to those droplets which are to be used for printing. While the charged droplets adhere to the recording paper, the rest of the ink is wasted. In an on-demand-type ink-jet recording head, ink is ejected only when it is needed for printing, so that no ink is wasted, with the interior of the apparatus being kept clean. Further, the on-demand system can be miniaturized relatively easily as compared with the continuous system. Therefore, at present, most of the recording apparatuses on the market are of the on-demand type. Since a recording apparatus equipped with a recording head of this ink-jet system is capable of high-density and high-speed recording, it being used and commercialized ad the output means of an information processing system, for example, as a printer serving as the output terminal of a copying machine, a facsimile apparatus, an electronic typewriter, a word processor, a work station or the like, or as a handy or portable printer with which a personal computer, a host computer, an optical disc apparatus, a video apparatus or the like is equipped. Ink-jet recording apparatuses thus used have constructions corresponding to the peculiar functions, forms of use, etc. of the associated information processing apparatuses.

Generally speaking, an ink jet recording apparatus comprises a carriage that carries recording means (a recording head) and an ink tank, conveying means for conveying recording paper, and control means for controlling these components. The recording head, which ejects ink droplets from a plurality of ejection holes, is made to perform serial scanning in a direction (main scanning direction) perpendicular to the recording-paper feeding direction (sub-scanning direction). When no recording is being performed, the recording paper is intermittently fed by an amount equal to the recording width at one time. This recording method, in which recording is effected by ejecting ink onto recording paper in response to recording signals, involves a relatively low running cost, so that it is widely used as a tranquil recording system. Further, by using a recording head in which a large number of nozzles for ejecting ink are linearly arranged in the sub-scanning direction, it is possible to record in a width corresponding to the number of nozzles by a single scanning over the recording paper by the recording head. Thus, it is possible to speed up the recording operation.

In the case of an ink jet recording apparatus capable of color recording, a color image is formed by superimposing ink droplets ejected from a recording head for a plurality of colors. Generally speaking, when performing color recording, it is necessary to use four recording heads corresponding to the three primary colors of Y (yellow), M (magenta) and C (cyan) or the four colors consisting of these three primary colors plus B (black). Nowadays, an apparatus on which such a recording head for three to four colors is mounted and which is capable of full color image formation has been put into practical use.

Further, in ink-jet recording apparatuses, various constructions for maintaining a satisfactory ejection of ink are usually provided. Due to such a construction, it is possible to prevent an increase in the viscosity of ink through evaporation at and near the ejection openings, where the ink is exposed to the air, or to remove the ink portion that has become excessively viscous. In particular, in a recording head of the bubble-jet type, the influence of an increase in ink viscosity may become relatively large since, in this type of recording head it is possible to form the ejection openings and the liquid passages communicating therewith, etc. in a very fine and highly intensive form. In view of this, such ink-jet recording apparatuses are equipped with a cap by means of which that face of the recording head on which the discharge holes are provided is sealed when the ejection of ink is not being effected. Further, for a more stable ejection of ink, a preliminary ejection, in which ink is ejected onto a predetermined spot that is not on the recording medium, is periodically performed, or a recovery operation, in which ink is automatically sucked when the power of the ink-jet recording apparatus is turned on. Further, from the viewpoint of running cost, the capacity of a waste-ink tank provided in the ink-jet recording apparatus, etc., a system for automatic recovery operation has been proposed, in which time measurement means is provided in the ink-jet recording apparatus and in which automatic suction is effected when a fixed period of time has elapsed without any printing signal having been input to the recording head or any ink ejected (Japanese Patent Laid-Open No. 3-234541 and No. 3-234543).

An example of the conventional ink-jet recording apparatus will be specifically described.

First, an ink-jet recording head (which, hereinafter, will also be simply referred to as the "recording head"), with which the ink-jet recording apparatus is equipped, will be described.

In the above recording head, the means for generating the energy for ink ejection may consist, for example, of an electromechanical converter, such as a piezoelectric element, or a device that heats liquid by an electro-thermal conversion element having a heat generating resistor.

In particular, a recording head which ejects liquid by utilizing heat energy (by utilizing a phenomenon called film boiling) is capable of recording with high resolution and miniaturization of the head since it allows a high-density arrangement of the liquid ejection openings and liquid paths communicated with the openings.

To facilitate the understanding of the prior-art technique and the present invention, an example of a conventional recording head and an ink jet recording apparatus equipped therewith will be described with reference to FIGS. 5 and 6.

FIG. 5 is a sectional perspective view for schematically illustrating the construction of an ink-jet recording head, which is mounted on an ink-jet recording apparatus.

Numeral 51 indicates a top plate, which has a plurality of grooves 53 serving as nozzles for passing ink, a groove 54 serving as a common liquid chamber communicating with these grooves, and a supply port 55 for supplying ink to the common liquid chamber. Numeral 52 indicates a base plate on which electro-thermal converters 56 respectively corresponding to the nozzles and electrodes 57 for supplying electric power to each electro-thermal converter are integrally formed by a film formation technique. The top plate 51 and the base plate 52 are combined with each other to form a plurality of ejection openings (orifices) 58.

The recording head 51, constructed as described above, is integrally combined with-an ink tank, which serves to supply ink to the recording head through the above-mentioned supply port, to constitute an ink-jet cartridge.

FIG. 6 is an external perspective view for schematically illustrating an ink-jet recording apparatus which is equipped with an ink-jet recording head as shown in FIG. 5.

In the drawing, numeral 20 indicates an ink-jet head (recording head) consisting of an IJC (ink-jet head cartridge) having a group of nozzles facing the recording surface of recording paper conveyed to a platen 24 and performing ink ejection. Numeral 16 indicates a carriage HC for holding the recording head 20. The carriage 16 is connected with a part of a driving belt for transmitting the driving force of a driving motor 17 and is slidable on two guide shafts 19A and 19B that are arranged parallel to each other, whereby the recording head 20 is capable of reciprocating over the entire width of the recording paper. During this reciprocation, the recording head 20 records an image corresponding to received data on the recording paper. For each cycle of this reciprocation, i.e., main scanning, the recording paper is fed by a predetermined amount for sub-scanning.

Numeral 26 indicates a head recovery device, which is arranged at one end of the travel path of the recording head, for example, at a position where it is opposed to the home position. The head recovery device 26 is operated by the driving force of a motor 22 transmitted through a transmission mechanism 23 to effect a capping of the recording head 20. An appropriate suction means (for example, a suction pump) is provided in the head recovery device 26 so as to be linked with that section of the head recovery device 26 in which the capping of the recording head 20 is effected with a cap section 26A. By using this suction means, an ejection recovery operation is performed, in which suction of ink (recovery through suction) is effected to thereby force ink out of the ejection ports, whereby, for example, the portion of ink in the ejection ports whose viscosity has increased is removed. This ejection recovery operation is conducted, for instance, when the power source is turned on, when the recording head-is replaced with a new one, or when recording operation is not performed for a certain period or over.

Numeral 31 indicates a blade serving as a wiping member made of silicone rubber and arranged on a side surface of the head recovery device 26. The blade 31 is held in a cantilever-like form by a blade holding member 31A, and, like the head recovery device 26, operated by the motor 22 and the transmission mechanism 23 to be engaged with the ejection surface of the recording head 20. This operation is performed such that the blade 31 is made to protrude into the travel path of the recording head 20 in an appropriate timing in relation to the recording operation of the recording head 20, or after ejection recovery by the head recovery device 26, to wipe off dew, moisture or dust.

The ink droplet forming process in the system utilizing thermal energy, effected with a recording head as described above, will be briefly described.

First, when the heat generating resistor (heater) has reached a predetermined temperature, a coating bubble which covers the heater surface is generated. The inner pressure of this bubble is so high as to push out the ink within the nozzle. The ink is moved toward the exterior of the nozzle and toward the common liquid chamber opposite thereto by the inertial force due to this pushing. As the ink continues to move, the internal pressure of the bubble becomes a negative pressure, and the velocity of the ink inside the nozzle decreases, which is partly due to the passage resistance. Once ejected outwardly from the nozzle opening (orifice), the ink moves more slowly than when it was inside the nozzle, so that a constriction is generated due to the inertial force and passage resistance, contraction of the bubble, and the surface tension of the ink, resulting in the ink being separated and turned into drops. Then, simultaneously with the contraction of the bubble, ink is supplied into the nozzle from the common liquid chamber by capillary attraction, and the next pulse is waited for.

In this way, a recording head using an electrothermal conversion element as the energy generating means is capable of generating a bubble in the ink inside the liquid passage in one-to-one correspondence by an electric pulse drive signal. Further, since it is possible to instantaneously and appropriately cause growth and contraction of bubbles, an ink drop ejection which particularly excels in responsiveness can be achieved. Further, the recording head is advantageous in that it easily allows high-density mounting and requires a relatively low production cost due to the ease with which the size of the recording head can be reduced and the possibility of making full use of the merits of the IC technique, micro processing technique, etc., in the field of semiconductors, which techniques have recently greatly advanced and been remarkably improved in reliability.

The conventional ink jet recording apparatus described above is also capable of relatively easily assuming a construction which allows recording on paper of a large size, such as A1. In this regard, a recording apparatus capable of A1-size color recording, for example, a plotter for CAD output printer, is commercially available. Further, there is a demand for a variety of uses for such apparatus. For example, there is an increasing demand for recording on OHP films that allow projection for presentation in conferences, lectures, etc. To meet this demand, there is being developed for commercial introduction a recording apparatus which allows selection of recording media having different ink absorption characteristics and which is capable of optimum recording independent of the kind of recording medium.

As described above, there is an increasing demand for ink-jet recording apparatuses as an excellent recording means in a wide variety of industries (e.g., the apparel industry). At the same time, there is also a demand for provision of images of a still higher quality.

However, the conventional recording apparatuses described above have a problem in that air bubbles can enter the ink-jet recording head and the ink supply duct for supplying ink from the ink container to the ink-jet recording head. In particular, during shipment of the ink-jet cartridge or in the case of an ink-jet cartridge in which the ink-jet recording head and the ink container are detachable from each other, air bubbles are liable to enter the ink-jet recording head and the ink supply duct when the ink container is replaced with a new one. An air bubble existing in the head will act as a core inviting atmospheric air from outside, resulting in the air bubbles being allowed to grow. In a relatively short period of negligence, the air bubble will grow, for example, to such a degree as to cause the interior of the head to be filled with atmospheric air to make ejection impossible, thus adversely affecting printing. Such air bubbles might be removed by increasing the number of times that automatic suction is Affected or the suction amount. However, if such increase is effected to excess, the running cost and, further, the amount of wasted ink will increase.

Thus, it is an object of this invention to solve the above problem and to provide an ink-jet recording apparatus and recovery method thereof which can obtain stable printing, and further an information processing system using this apparatus as the output means.

SUMMARY OF THE INVENTION

To achieve the above object, there is provided, in accordance with this invention, an ink-jet recording apparatus for use of a detachable ink-jet recording head for ejecting ink and a detachable ink container for containing ink to be supplied to the recording head, comprising: recovery means for recovering a condition for ejecting ink for the ink-jet recording head; detection means for detecting a replacement of the ink container or a refilling thereof with ink; counting means for counting the number of times N that recovery is executed by the recovery means; measurement means for measuring the period of time elapsing between the time t0 at which last ink ejection from the ink-jet recording head was finished and the time t at which ink ejection from said ink-jet recording head is newly performed; and control means for controlling the recovery means according to detection result by the detection means, counting result by the counting means and measurement result by the measurement means.

Preferably, the above recovery operation by the recovery means is automatically executed by the control means, and the interval between executions of recovery is shortest directly after the replacement of the ink container or the refilling into the ink container with ink.

Preferably, a predetermined period of time that depends upon the number of times N is set and the control means causes the recovery means to operate to execute the recovery operation when the above times t0, t1 and t satisfy the relationship of the following inequality:

$$t1<t-t0$$

Preferably, the above-mentioned counting means is reset when a replacement of the ink container or a refilling of the ink container with ink is detected by the detection means. The value of the time t1 is set at a large value in accordance with the number of times N that the above recovery operation is executed after the replacement of the ink container or the refilling of the ink container with ink.

Preferably, the above recovery means sucks ink from the ink ejection openings of the ink-jet recording head. The amount of ink W sucked by a single sucking operation depends upon the number of times of execution N.

Preferably, the number of times X that the above recovery operation is continuously executed is determined depending upon the above number of times N. Further, it is preferable that, when the above number of times N satisfies the inequality:

$$N\geqq 7$$

the above number of times X is 1.

Preferably, the ink-jet recording head and the ink container are joined together so as to be detachable from each other.

Further, it is preferable that the ink jet recording head have an electro-thermal converter for generating thermal energy as energy generating means for generating energy utilized to eject ink.

The present invention also provides an information processing system featuring the above ink-jet recording apparatus, which is provided therein as an output means.

The present invention further provides a recovery method of an ink-jet recording apparatus, comprising: detection step for detecting a replacement of an ink container detachable from an ink-jet recording head for containing ink to be supplied to said ink-jet recording head or a refilling with ink into said ink container; and recovery step for recovering said ink-jet recording head at shorter interval directly after detection in said detection step than subsequent recovery intervals, each of said recovery intervals becomes long gradually till next detection.

Due to the above construction, it is possible to appropriately and reliably execute a recovery operation at the occasion of ink container replacement or ink refilling and, further, a recovery operation that is in accordance with the number of times that recovery operation has been executed and with the execution intervals of recording operation, whereby it is always possible to form a stable, high-quality image.

DETAILED DESCRIPTION OF THE PREFERRED EMBODIMENTS

Embodiments of the present invention will now be described in detail with reference to the drawings.

[First Embodiment]

Figure 1A:
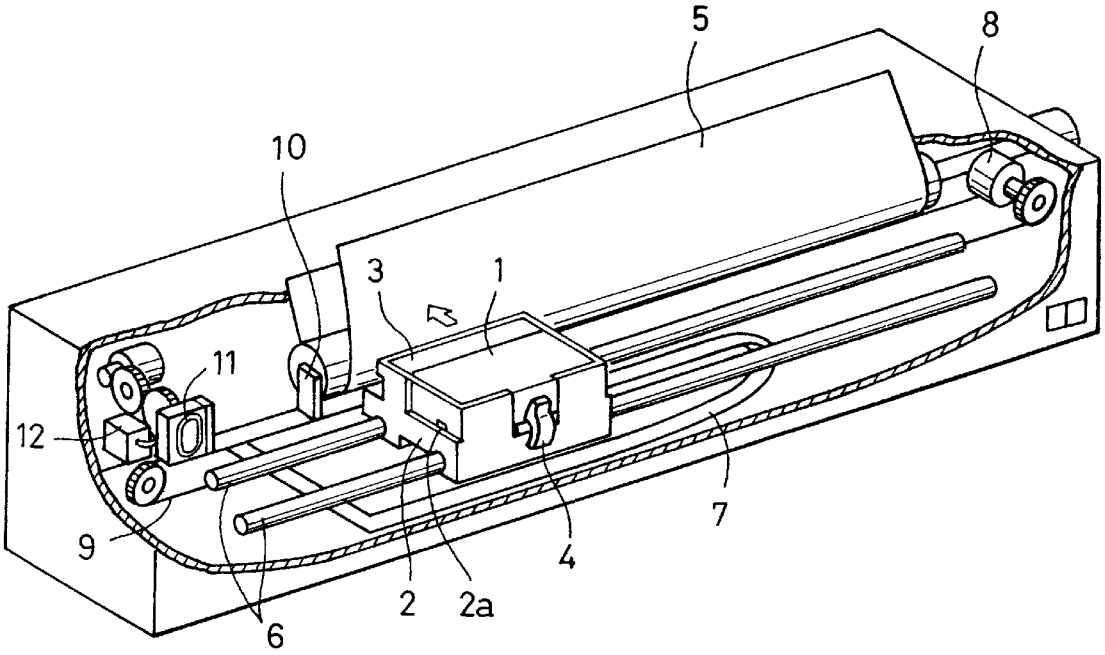
FIG. 1A is a perspective view for schematically illustrating the construction of an example of the ink-jet recording apparatus of the present invention.
Figure 1B:
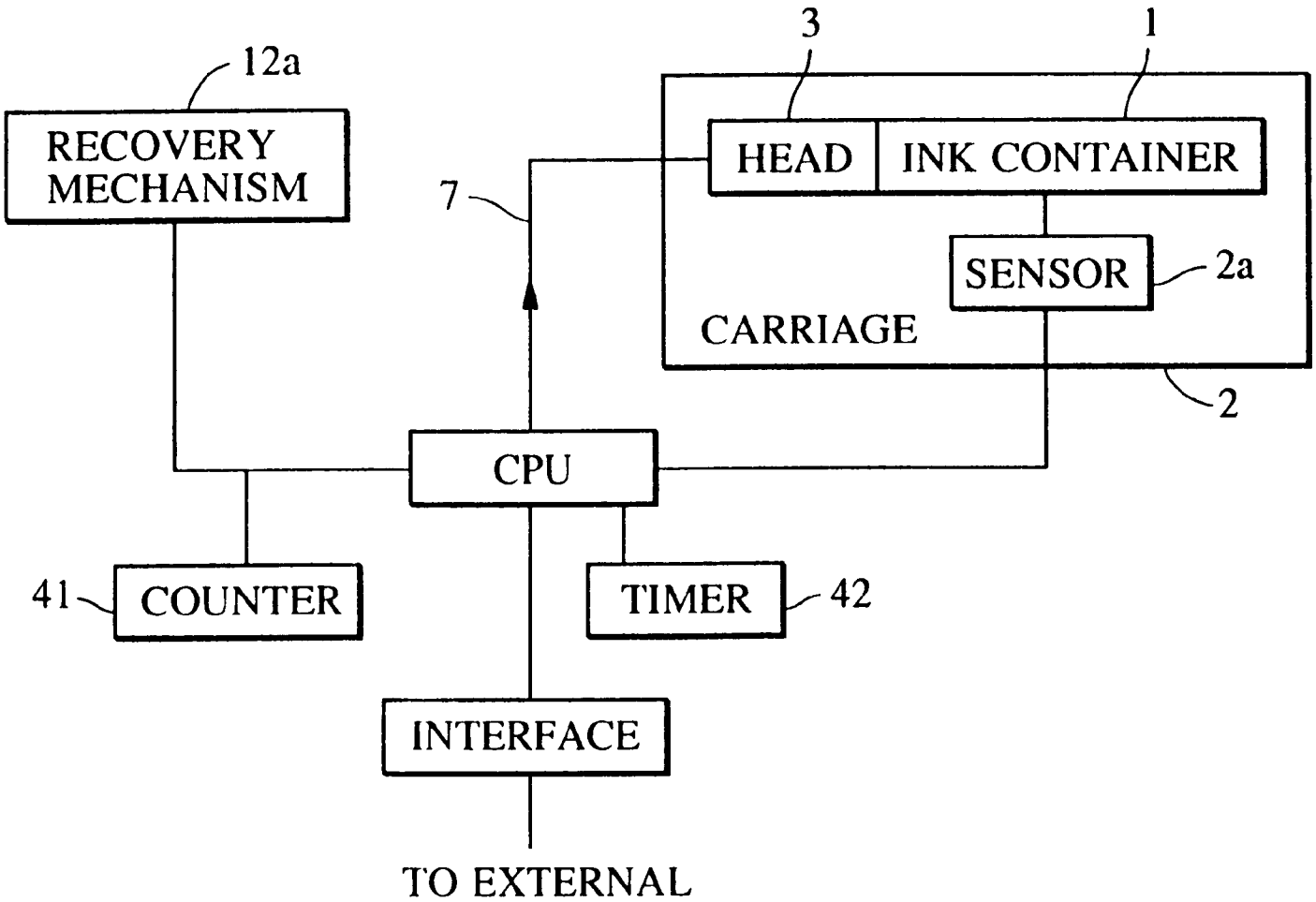
FIG. 1B is an equivalent block diagram of the ink-jet recording apparatus.

FIG. 1A is a perspective view for schematically illustrating the construction of an example of the ink-jet recording apparatus of the present invention, and FIG. 1B is an equivalent block diagram of the ink-jet recording apparatus. In FIGS. 1A and 1B, numeral 1 indicates an ink container, which is detachably mounted on a carriage 2, is fastened to the carriage 2 by a holding member 4. A sensor 2*a* having electrical contacts for detecting the presence of an ink container 1 is provided inside the carriage 2. An ink-jet recording head 3 for ejecting ink to print on a recording medium 5 is provided in the forward section of the carriage 2 detachably from the ink container 1. The carriage 2 is adapted to slide on a shaft 6 to reciprocate along the longitudinal dimension thereof. An ejection signal, supplied through a cable 7, is applied to an electrothermal converter, which is provided in the recording head to serve as the ejection energy generating element used for the purpose of ejecting ink. Numeral 8 indicates a carriage motor for reciprocating the carriage on the shaft 6; and numeral 9 indicates a belt for transmitting the driving force of a motor 8 to the carriage 2. Numeral 10 indicates a blade for wiping off dust, foreign matter, ink remaining on the ejection surface after head recovery operation, etc. Numeral 11 indicates a cap, which constitutes a recovery mechanism 12*a* with a tube pump 12. For recovery of the ink-jet recording head, a tube pump 12 operates to suck ink from discharge openings while the cap 11 is covering the discharge openings. Preliminary ejection is also performed into this cap 11. Further, when a long period of time is to be elapsed without any printing signal being applied to the ink-jet recording head 3, the ejection openings are protected by the cap 11, with which the ink-jet recording head 3 is equipped. Due to this arrangement, it is possible, for example, to prevent clogging of the ejection openings caused by drying of the ink remaining in and around them.

Figure 2:
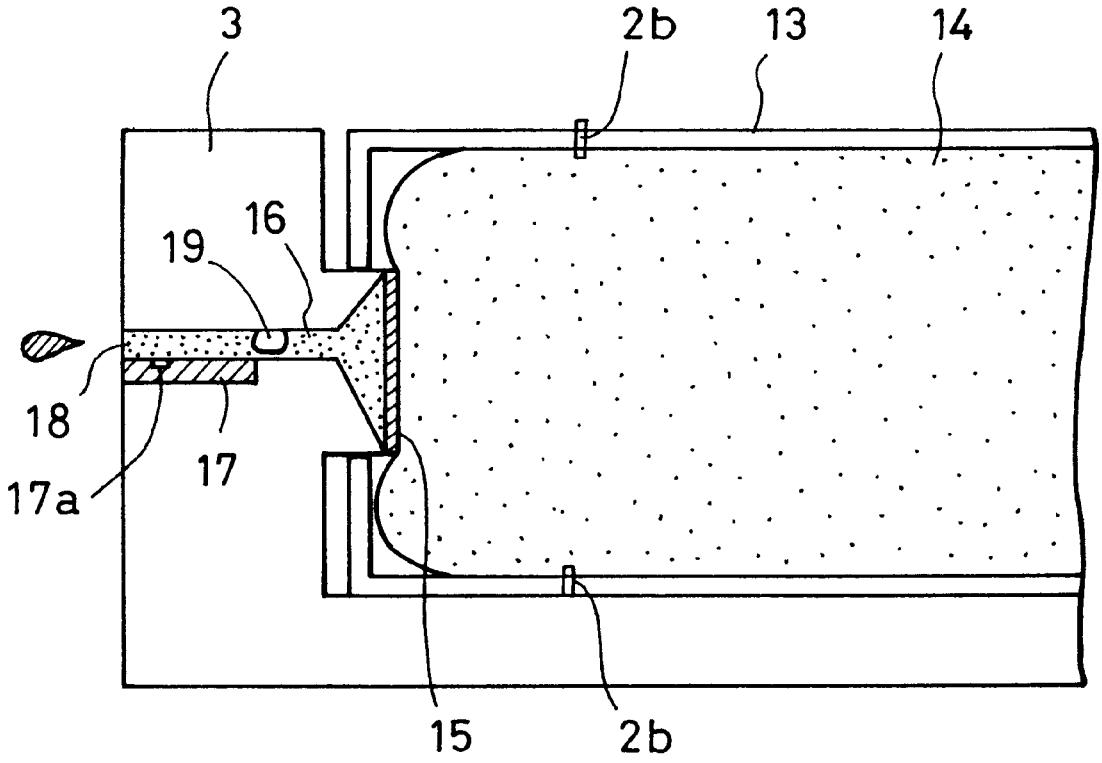
FIG. 2 is a sectional view for illustrating the construction of the joint section between an ink-jet recording head and an ink container, which are mounted on an ink-jet recording apparatus according to the present invention.

FIG. 2 is a sectional view showing the joint section between the ink-jet recording head and the ink container of this embodiment. A porous member 14 impregnated with ink is inserted into the interior of an ink container 13, and a filter 15 provided in the ink-jet recording head 3, is held in press contact with the porous member 14. Numeral 16 indicates an ink passage, through which ink drawn from the ink container 13 passes and receives ejection energy from heat generating portions 17*a* of electro-thermal converters equipped on a heater board 17, before it is ejected from the ejection holes 18 to effect printing on the recording medium. If the recording is performed after replacement of the ink container, air bubbles 19 are liable to remain in the ink passage 16. Further, due to evaporation of ink from the molded wall, defining the ink passage, of the ink-jet recording head, more air bubbles will be allowed to stay in the ink passage. Thus, immediately after replacement of the ink container, the ink ejection of the ink-jet recording head is liable to be rather unstable.

Figure 3:
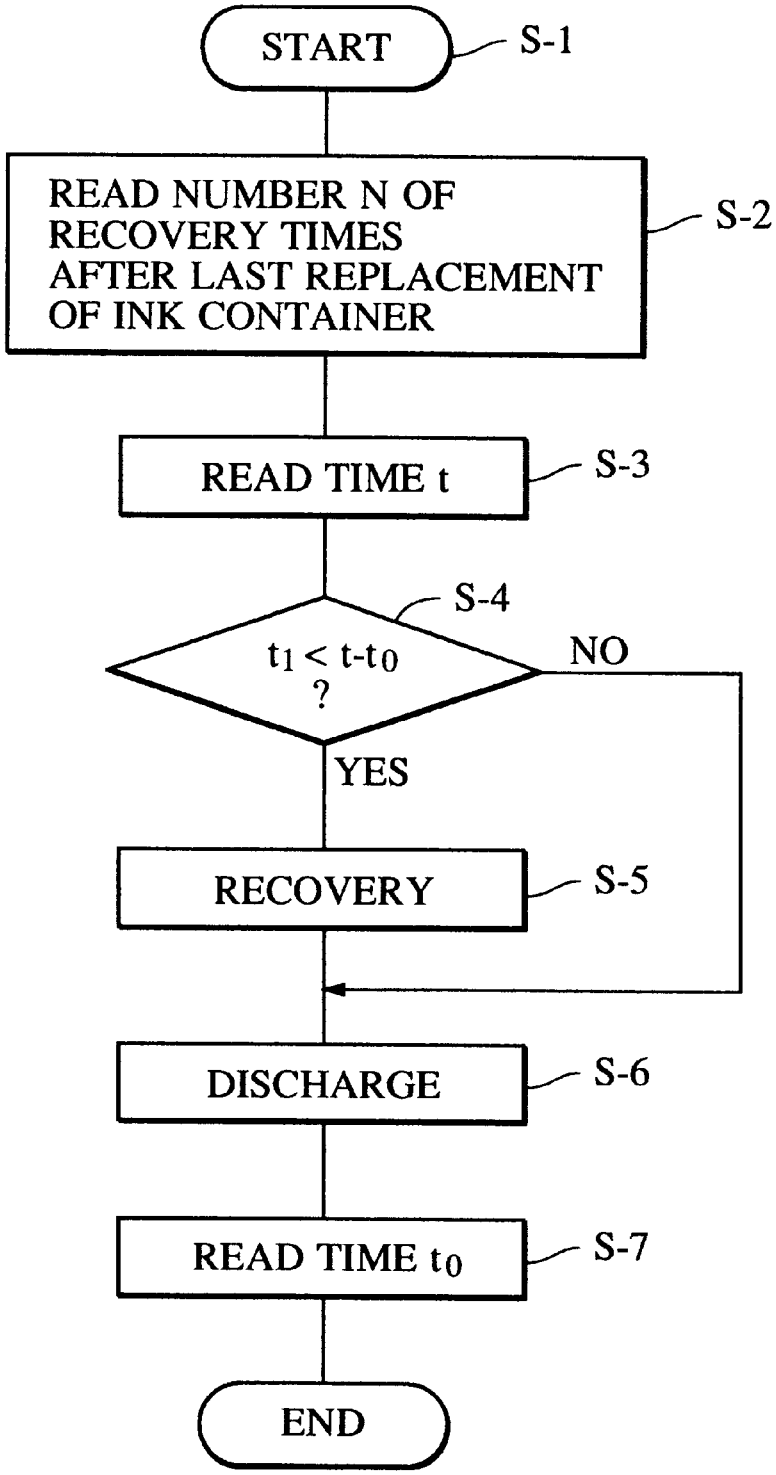
FIG. 3 is a flowchart for illustrating an example of the process for recovery operation applicable to an ink-jet recording apparatus according to the present invention.

FIG. 3 is a flowchart showing operational procedures applicable to this embodiment. The recovery operation is started when a printing signal is input to the ink-jet recording head. However, it is also possible to set the apparatus such that the operation is automatically started upon turning on of the power source or whenever the user inputs an execution command for this recovery operation.

First, when the recovery operation is started (S-1), the number of times N that recovery operation has been executed after the last replacement of the ink container is read in (S-2) from a counter 41 indicated in FIG. 1B. A command for this reading is reset each time the ink container is replaced with a new one. Further, though not shown in the flowchart of FIG. 3, the first recovery operation (N=1) is executed automatically for each ink container replacement. Of course, instead of automatically executing this recovery operation, it is also possible to adopt a system in which a command for this recovery operation is input by the user.

Next, the current time t is read in (S-3) from a timer 42 indicated in FIG. 1B. After this, the time t0 read in upon the termination of the last ink ejection is subtracted from the current time t (S-4). Then, the value of (t−t0), obtained in step S-4, and the value of t1 are compared with each other.

TABLE 1

| N (number of times) | t1 (time) |
|---|---|
| 1 | 12 |
| 2 | 24 |
| 3 | 48 |
| 4 or more | 72 |

Table 1 shows values of the number of times of recovery execution N in correspondence with values of the time t1. For example, when N=2, t1=24, and this value of t1 is substituted into the following relationship formula for step S-4:

$$t1<t-t0 \quad (1)$$

(1)

When the value obtained in step S-4 satisfies formula (1), recovery operation is automatically executed (S-5). After the execution, regular ejection of ink is effected (S-6).

When the value obtained in step S-5 does not satisfy formula (1) (that is, when t1≧t−t0), regular ejection of ink is effected without being preceded by any recovery operation (S-6).

When the ejection of ink has been completed, the time of completion t0 is read in, with which the operation is terminated (S-7 and S-8).

[Second Embodiment]

Figure 4:
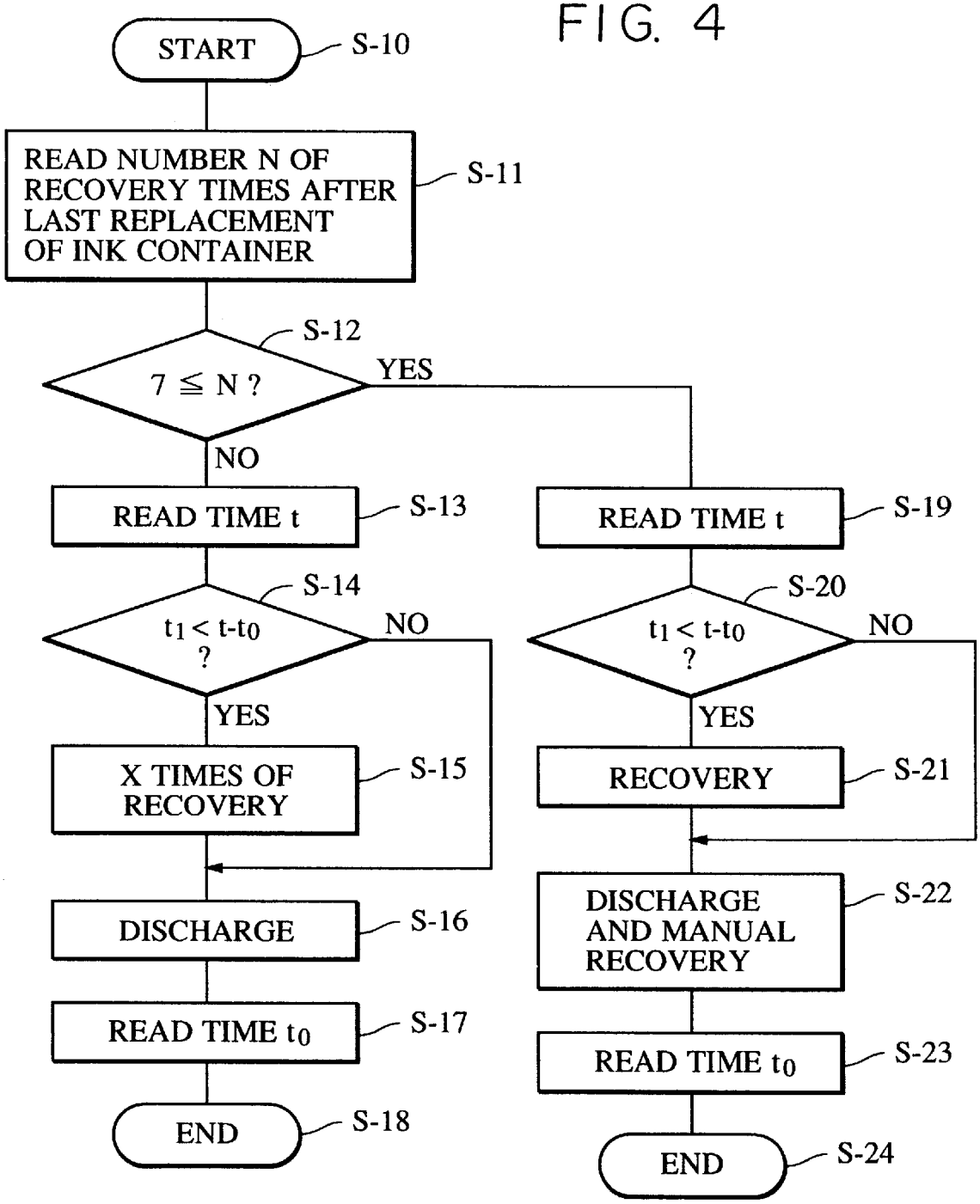
FIG. 4 is a flowchart for illustrating another example of the process for recovery operation applicable to an ink-jet recording apparatus according to the present invention.
Figure 5:
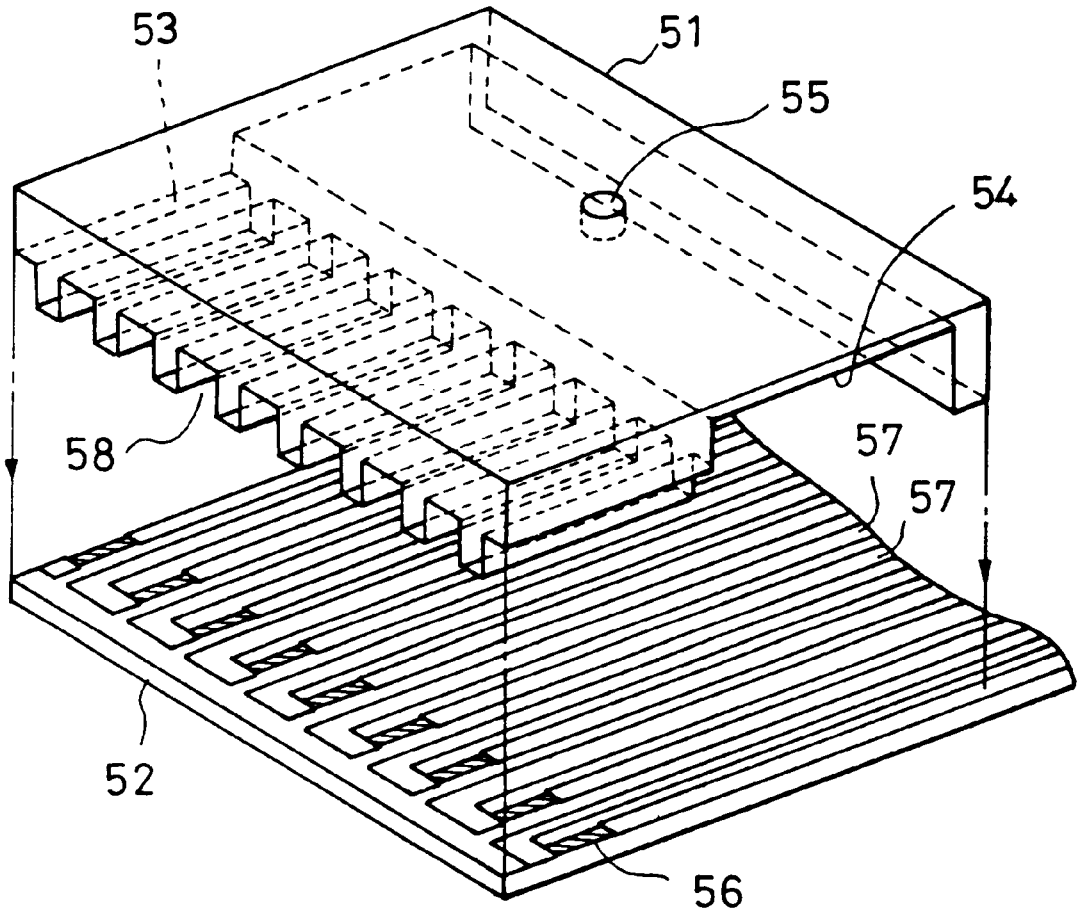
FIG. 5 is a perspective view for schematically illustrating the construction of an ink-jet recording head.
Figure 6:
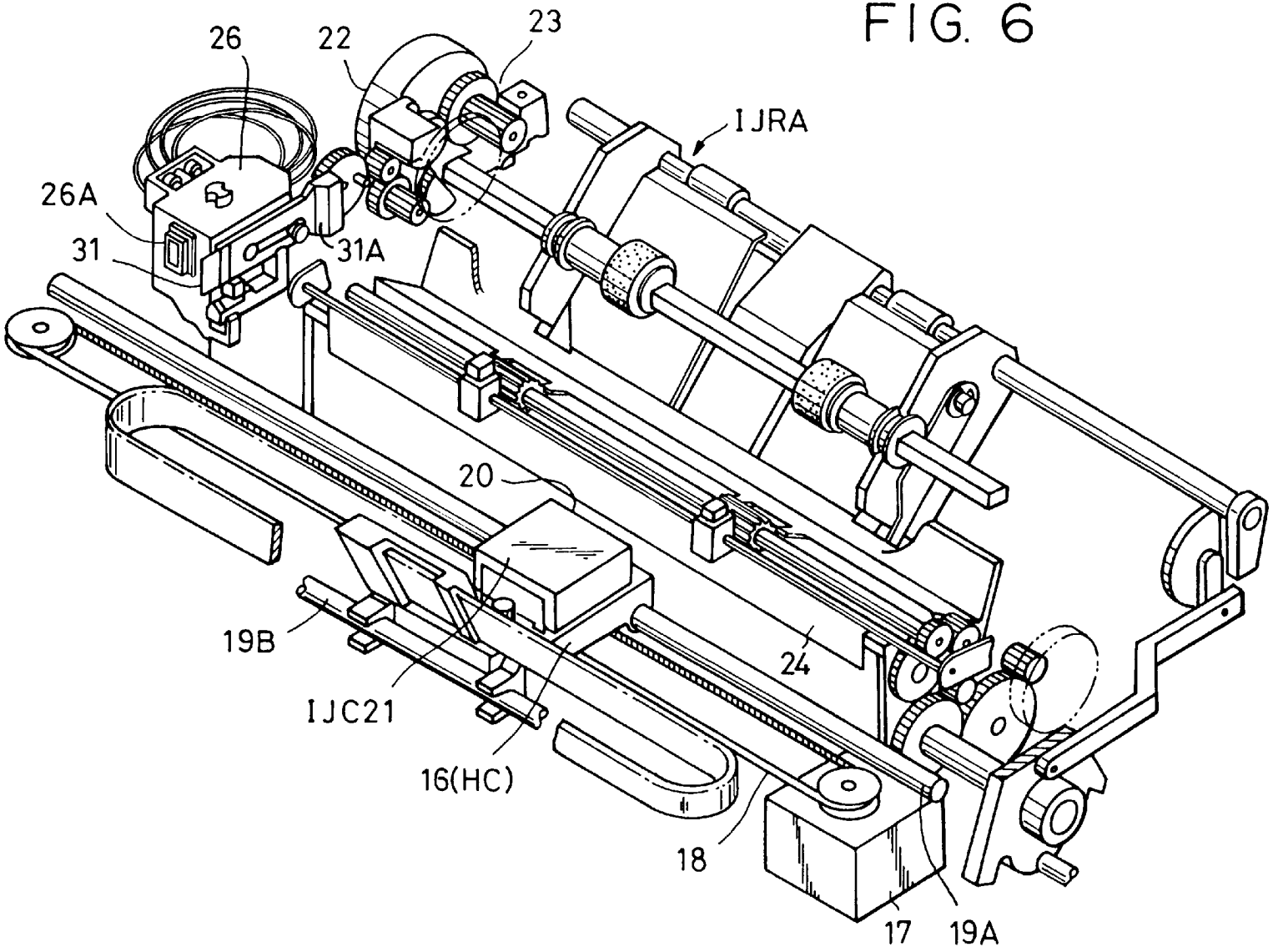
FIG. 6 is a perspective view for schematically illustrating a conventional ink-jet recording apparatus.

FIG. 4 is a flowchart for illustrating another example of the operational process applicable to the ink-jet recording apparatus of the present invention.

This process is started when a printing signal is input to the ink-jet recording head. However, it is also possible to set the apparatus such that the process is started automatically upon turning on of the power or when the user inputs an execution command for this process.

First, when this process is started (S-10), the number of times N that recovery operation has been executed since the last replacement of the ink container is read in (S-11). The command for this reading is reset for each ink-container replacement. Further, though not shown in the flowchart of FIG. 4, the first recovery operation (N=1) is automatically conducted each time the ink container is replaced with a new one. Of course, it is also possible to adopt a system in which this recovery operation is not executed automatically but in response to a command input by the user.

When the above number of times N has a value smaller than 7 (S-12), the procedure advances to steps S-13~S-18.

First, the current time t is read in (S-13). After this, the time t0 read in at the completion of the last ink ejection is subtracted from the current time t (S-14). Then, the value (t−t0) obtained in step S-14 is compared with the value of t1 in Table 1.

When the value obtained in step S-14 satisfies the above formula (1), recovery operation is automatically executed (S-15).

The recovery operation in step S-15 is executed a number of times X, which is based on Table 2. For example, when N=1, the recovery operation (pumping) is executed three times.

TABLE 2A

| N (number of times) | X (number of times) |
|---|---|
| 1, 2 | 3 |
| 3, 4 | 2 |
| 5, 6 | 1 |

After the execution, regular ejection of ink is performed (S-16).

When the value obtained in step S-13 does not satisfy formula (1) (t1≧t−t0), usual ink discharge operation is performed without recovery (S-16). When this ink discharge operation is finished, this finished time t0 is read and the procedure is finished (S-17 and S-18). When the above number of times N is not less than 7(S-12), the procedure advances to steps S-19~S-24.

First, the current time t is read in (S-19). After this, the time t0 read in at the completion of the last ink ejection is subtracted from the current time t (S-20). Then, the value (t−t0) obtained in step S-19 is compared with the value of t1 in Table 1.

When the value obtained in step S-14 satisfies the above formula (1), recovery operation is automatically executed.

After the execution, regular ejection of ink and manual recovery (recovery according to the manual recovery button in the apparatus) are performed (S-22).

When the value obtained in step S-20 does not satisfy formula (1) (that is, when t1≧t−t0), the procedure advances to step S-22, without any recovery operation being performed.

When the ejection of ink has been completed, the time t0 of the completion of the ejection is read in, with which the process is terminated (S-23 and S-24).

In this embodiment, as in the first embodiment described above, the command to perform automatic recovery operation is given on the basis of the number of times that recovery has been effected since the replacement of the ink-container and the time which has elapsed from the last ejection by the ink-jet recording head to the input of a printing signal thereto. In this embodiment, the amount of ink sucked in the earlier stage is relatively large, whereby the air bubbles existing in the ink passage in the ink-jet recording head can be easily removed. Further, while in this embodiment the amount of ink sucked is varied in accordance with the times that the number that recovery through suction has been effected, it is also possible for the amount of ink sucked to be varied in accordance with the operating amount of the suction pump, etc.

[Third Embodiment]

In this embodiment, the same steps as those described in FIG. 3 are executed except step S-2. Instead of reading the number N of times that recovery operation has been executed after the last replacement of the ink container, the number N of times that recovery operation has been executed after the last ink filling into the ink container is read in step S-2. The presence of ink filled into the ink container through, for example, a vent hole (not shown) is detected with a sensor having electrical contacts 2*b* indicated in FIG. 2.

[Fourth Embodiment]

In this embodiment, the same steps as those described in FIG. 4 are executed except step S-11. Instead of reading the number N of times that recovery operation has been executed after the last replacement of the ink container, the number N of times that recovery operation has been executed after the last ink filling into the ink container is read in step S-11. The presence of ink filled into the ink container through, for example, a vent hole (not shown) is detected with a sensor having electrical contacts 2*b* indicated in FIG. 2.

The ink-jet recording apparatus of the present invention comprises: recovery means for recovering a condition for ejecting ink for an ink-jet recording head; detection means for detecting a replacement of ink container or a refilling of ink container with ink; counting means for counting the number of times N that recovery operation has been executed by the recovery means; measurement means for measuring the period of time that has elapsed since the time of last execution of recording operation to the moment at which recording is newly effected; and control means for controlling the operations of the detection means, count means and measurement means. The information processing system of the present invention uses this ink-jet recording apparatus as the output means. Thus, it is possible to appropriately and reliably perform recovery operation effected at the occasion of-ink-container replacement or ink refilling, or in accordance with the number of times that recovery operation has been performed or in accordance with the intervals at which recording operation is conducted, whereby it is always possible to form a stable, high-quality image.

What is claimed is:

1. An ink-jet recording apparatus for use with a detachable ink-jet recording head for ejecting ink and a detachable ink container for containing ink for supply to said recording head, the apparatus comprising:

recovery means for performing a recovery operation to maintain satisfactory election of ink from said ink-jet recording head;

detection means for detecting at least one of a presence of the ink container in the apparatus, to thereby detect a replacement of the ink container, and a refilling of the ink container with ink;

control means, connected to said recovery means and to said detection means, for controlling said recovery means to recover said ink-jet recording head at a shorter interval directly after detection by said detection means than subsequent recovery intervals, each of said recovery intervals becoming longer as time passes until a next detection by said detection means.

2. An ink-jet recording apparatus according to claim 1, wherein said control means controls said recovery means to automatically execute said recovery operation, and wherein an interval between recovery operations is shortest directly after at least one of replacement of the ink container and refilling of the ink container with ink.

3. An ink-jet recording apparatus according to claim 1 or 2, wherein a period of time t1 that depends upon a number of recovery operations N is set and said control means causes said recovery means to perform the recovery operation when times t, to and t1 satisfy the inequality $$t1<t-t0,$$

where t is a time at which a current ink ejection from said ink-jet recording head is performed and t0 is a time at which a previous ink ejection from said ink-jet recording head was finished.

4. An ink-jet recording apparatus according to claim 3, wherein a value of the time t1 is set at a large value in accordance with the number of recovery operations N after at least one of the replacement of the ink container and the refilling of the ink container with ink.

5. An ink-jet recording apparatus according to claim 3, wherein said recovery means sucks ink from the ink ejection openings of the ink-jet recording head, and wherein an amount W of ink sucked in a single sucking operation depends upon the number of recovery operations N.

6. An ink-jet recording apparatus according to claim 3, wherein a value X indicating a number of times that said recovery operation is continuously executed is determined depending upon said number of recovery operations N.

7. An ink-jet recording apparatus according to claim 6, wherein the value X is equal to 1 when said number of recovery operations N satisfies the relationship N>7.

8. An ink-jet recording apparatus according to claims 1 or 2, wherein the ink-jet recording head and the ink container are detachable from one another.

9. An ink-jet recording apparatus according to claims 1 or 2, wherein the ink jet recording head has an electro-thermal convertor generating thermal energy to eject ink.

10. An ink-jet recording apparatus according to one of claims 1 or 2, comprising an output device for an information processing system.

11. A recovery method of an ink-jet recording apparatus, comprising the steps of:

detecting at least one of a replacement of an ink container detachable from an ink-jet recording head for containing ink being supplied to said ink-jet recording head and a refilling of said ink container with ink; and recovering said ink-jet recording head at a shorter interval directly after detection in said detecting step than subsequent recovery intervals, each of said recovery intervals becoming longer as time passes until a next detection.

12. A recovery method of an ink-jet recording apparatus, comprising the steps of:

detecting at least one of a replacement of an ink container detachable from an ink-jet recording head for containing ink for supply to said ink-jet recording head and a refilling of said ink container with ink; and recovering said ink-jet recording head plural times with recovery intervals after detection in said detecting step, at least one of said recovery intervals being shorter than subsequent recovery intervals and other recovery intervals becoming longer or unchanged as time passes until a next detection.

* * * * *

UNITED STATES PATENT AND TRADEMARK OFFICE

CERTIFICATE OF CORRECTION

PATENT NO. : 5,900,889

DATED : May 4, 1999

INVENTOR(S) : Keiichiro Tsukuda

It is certified that error appears in the above-identified patent and that said Letters Patent is hereby corrected as shown below:

Column 1

Line 42, change "it" to --it was--, and change "ad" to --as--.

Column 3

Line 15, change "with-an" to --with an--; and
line 54, change "head-is" to --head is--.

Column 5

Line 9, change "Affected" to --effected--.

Column 10

Line 37, change "ink;" to --ink; and--; and
line 55, change "to" to --t0--.

UNITED STATES PATENT AND TRADEMARK OFFICE

CERTIFICATE OF CORRECTION

PATENT NO. : 5,900,889

DATED : May 4, 1999

INVENTOR(S) : Keiichiro Tsukuda

It is certified that error appears in the above-identified patent and that said Letters Patent is hereby corrected as shown below:

Column 11

Line 12, change "N > 7" to --N ≥ 7--.

Signed and Sealed this

Twenty-first Day of December, 1999

*Attest:*

Q. TODD DICKINSON

*Attesting Officer*

*Acting Commissioner of Patents and Trademarks*